United States Patent [19]

Iizuka et al.

[11] 4,376,426

[45] Mar. 15, 1983

[54] SPLIT TYPE INTERNAL COMBUSTION ENGINE

[75] Inventors: Haruhiko Iizuka, Yokosuka; Fukashi Sugasawa, Yokohama, both of Japan

[73] Assignee: Nissan Motor Company, Limited, Yokohama, Japan

[21] Appl. No.: 216,181

[22] Filed: Dec. 15, 1980

[30] Foreign Application Priority Data

Dec. 20, 1979 [JP] Japan ..... 54-166158

[51] Int. Cl.[3] ..... F02D 17/00

[52] U.S. Cl. ..... 123/198 F; 123/580

[58] Field of Search ..... 123/198 F, 580

[56] References Cited

U.S. PATENT DOCUMENTS

| | | | |
|---|---|---|---|
| 3,578,116 | 5/1971 | Nakajima et al. | 123/198 F |
| 4,201,180 | 5/1980 | Lizuka | 123/198 F |
| 4,292,938 | 10/1981 | Tanaka et al. | 123/198 F |
| 4,296,719 | 10/1981 | Takahashi et al. | 123/198 F |
| 4,304,208 | 12/1981 | Etoh et al. | 123/198 F |

FOREIGN PATENT DOCUMENTS

| | | |
|---|---|---|
| 2131249 | 12/1972 | Fed. Rep. of Germany . |
| 2517906 | 10/1976 | Fed. Rep. of Germany . |
| 2900953 | 7/1979 | Fed. Rep. of Germany . |

OTHER PUBLICATIONS

Nahverkehrs-Praxis, (pp. 350 to 352): Dec. 1958.

*Primary Examiner*—Ira S. Lazarus

*Attorney, Agent, or Firm*—Schwartz, Jeffery, Schwaab, Mack, Blumenthal & Koch

[57] ABSTRACT

An internal combustion engine is disclosed which comprises first and second cylinder units each including at least one cylinder, an induction passage divided downstream of the throttle valve into first and second intake passages leading to first and second cylinder units, respectively, a vacuum tank held at a vacuum above that in the induction passage downstream of the throttle valve, a stop valve provided at the entrance of the second intake passage and adapted to move toward its closed position when connected to the vacuum tank, and a control circuit adapted to block the supply of fuel to the second cylinder unit and connect the vacuum tank to the stop valve thereby shifting the engine operation into a split engine mode when the engine load is below a predetermined value. The control circuit includes means for forcing the engine operation into its full cylinder mode regardless of engine load conditions before the vacuum in the vacuum tank reaches a value sufficient to move the stop valve to its fully closed position.

7 Claims, 3 Drawing Figures

SPLIT TYPE INTERNAL COMBUSTION ENGINE

BACKGROUND OF THE INVENTION

1. Field of the Invention

This invention relates to improvements in an internal combustion engine of the split type operable on less than all of its cylinders when the engine load is below a given value.

2. Description of the Prior Art

It is known and desirable to increase the efficiency of a multicylinder internal combustion engine by reducing the number of cylinders on which the engine operates under predetermined engine operating conditions, particularly conditions of low engine load. Control systems have already been proposed which disable a number of cylinders in a multicylinder internal combustion engine by suppressing the supply of fuel to certain cylinders or by preventing the operation of the intake and exhaust valves of selected cylinders. Under given load conditions, the disablement of some of the cylinders of the engine increases the load on those remaining in operation and, as a result, the energy conversion efficiency is increased.

It is common practice to introduce exhaust gases into the disabled cylinders through an EGR valve adapted to open under given low load conditions and to prevent the introduced exhaust gases from flowing to the cylinders reamining in operation by the use of a stop valve adapted to close in timed relation with the opening of the EGR valve. This is effective to suppress pumping loss in the disabled cylinders and attain higher fuel economy.

With such conventional split type internal combustion engines, one difficulty has been assuring that the stop valve was operated at the proper timing. If the stop valve remains open when the EGR valve opens, a great amount exhaust gases will flow over the stop valve, arising many problems.

The present invention provides an improved split type internal combustion engine which is free from the above described disadvantages found in conventional split type internal combustion engines.

SUMMARY OF THE INVENTION

In accordance with the present invention, there is provided an internal combustion engine comprising first and second cylinder units each including at least one cylinder, an induction passage provided therein with a throttle valve and divided downstream of the throttle valve into a first intake passage leading to the first cylinder unit and into a second intake passage leading to the second cylinder unit, a vacuum tank held at a vacuum above that in the induction passage downstream of the throttle valve, a stop valve provided at the entrance of the second intake passage and adapted to move toward its closed position when connected to the vacuum tank, and a control circuit adapted to normally place the engine in a full engine mode of operation and to block the supply of fuel to the second cylinder unit and connect the vacuum tank to the stop valve thereby shifting the engine operation into a split engine mode when the engine load is below a predetermined value. The control circuit includes means for forcing the engine operation into its full cylinder mode regardless of engine load conditions before the vacuum in the vacuum tank reaches a value sufficient to move the stop valve to its fully closed position. Thus, when the engine operation is in a split engine mode, the vacuum in the vacuum tank is always above a level sufficient to move the stop valve to its fully closed position.

The means may comprises a timer adapted to provide a signal for a predetermined period of time after the engine starts, and means responsive to the signal from the timer for forcing the engine operation into its full engine mode regardless of engine load conditions. The timer may be replaced with a vacuum sensor adapted to provide a signal when the vacuum in the vacuum tank or in the induction passage downstream of the throttle valve.

BRIEF DESCRIPTION OF THE DRAWINGS

The present invention will be described in greater detail by reference to the following description taken in connection with the accompanying drawings, in which like reference numerals refer to the same or corresponding parts, and wherein.

DESCRIPTION OF THE PREFERRED EMBODIMENTS

Figure 1:
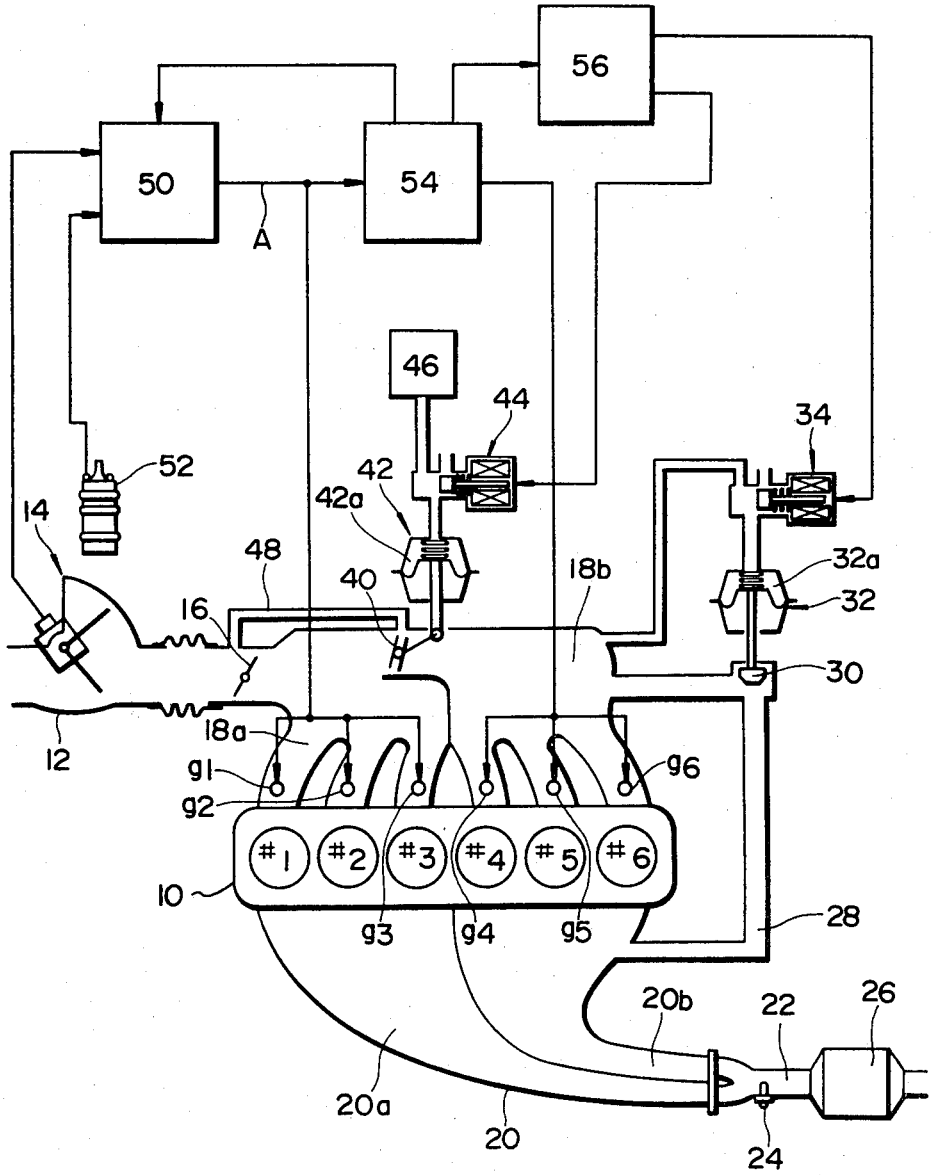
FIG. 1 (PRIOR ART)
FIG. 1 is a schematic sectional view showing a conventional split type internal combustion engine.

Prior to the description of the preferred embodiments of the present invention, we shall briefly describe the prior art split type internal combustion engine in FIG. 1 in order to specifically point out the difficulties attendant thereon.

Referring to FIG. 1, the reference numeral 10 designates an engine block containing therein an active cylinder unit including three cylinders #1 to #3 being always active and an inactive cylinder unit having three cylinders #4 to #6 being inactive when the engine load is below a predetermined value. Air is introduced to the engine through an air induction passage 12 provided therein with an airflow meter 14 and a throttle valve 16 drivingly connected to the accelerator pedal (not shown) for controlling the flow of air to the engine. The induction passage 12 is connected downstream of the throttle valve 16 to an intake manifold 18 which is divided into first and second intake passages **18*a* and 18*b*. The first intake passage 18*a* leads to the active cylinders #1 and #3 and the second intake passage 18*b* leads to the inactive cylinders #4 to #6**.

The engine also has an exhaust manifold 20 which is divided into first and second exhaust passages **20*a* and 20*b* leading from the active cylinders #1 to #3 and the inactive cylinders #4 to #6, respectively. The exhaust manifold 20 is connected at its downstream end to an exhaust duct 22 provided therein with an exhaust gas sensor 24 and an exhaust gas purifier 26 located downstream of the exhaust gas sensor 24. The exhaust gas sensor 24 may be in the form of an oxygen sensor which monitors the oxygen content of the exhaust and is effective to provide a signal indicative of the air/fuel ratio at which the engine is operating. The exhaust gas purifier 26 may be in the form of a three-way catalytic converter which effects oxidation of HC and CO and reduction of NOx so as to minimize the emission of pollutants through the exhaust duct 22**. The catalytic converter exhibits its maximum performance at the stoichiometric air/fuel ratio. In view of this, it is desirable to maintain the air/fuel ratio at the stoichiometric value.

An exhaust gas recirculation (EGR) passage 28 is provided which has its one end opening into the second exhaust passage 20*b* and the other end thereof opening into the second intake passage 18*b*. The EGR passage 28 has therein an EGR valve 30 which opens to permit recirculation of exhaust gases from the second exhaust passage 20*b* into the second intake passage 18*b* so as to minimize pumping losses in the inactive cylinders #4 to #6 during a split engine mode of operation where the engine operates on the three cylinders. The EGR valve 30 closes to prevent exhaust gas recirculation during a full engine mode of operation where the engine operates on all of the cylinders #1 to #6.

The EGR valve 30 is driven by a first pneumatic valve actuator 32 which includes a diaphragm spreaded within a casing to define therewith two chambers on the opposite sides of the diaphragm, and an operating rod having its one end centrally fixed to the diaphragm and the other end thereof drivingly connected to the EGR valve 30. The working chamber 32*a* is connected to the outlet of a first three-way solenoid valve 34 which has an atmosphere inlet communicated with atmospheric air and a vacuum inlet connected through a conduit 36 to the second intake passage 18*b*. The first solenoid valve 34 is normally in a position providing communication between the first valve actuator working chamber 32*a* and atmospheric air so as to close the EGR valve 30. During a split engine mode of operation, the first solenoid valve 34 is moved to another position where communication is established between the first valve actuator working chamber 32*a* and the second intake passage 18*b*, thereby opening the EGR valve 30.

The second intake passage 18*b* is provided at its entrance with a stop valve 40 normally opens to permit the flow of fresh air through the second intake passage 18*b* into the inactive cylinders #4 to #6. The stop valve 40 closes to block the fresh air flow to the inactive cylinders #4 to #6 during a split engine mode of operation. The stop valve 40 may be in the form of a double-faced butterfly valve having a pair of valve plates facing in spaced-parallel relation to each other. A conduit 48 is provided which has its one end opening into the induction passage 12 at a point upstream of the throttle valve 16 and the other end thereof opening into the second intake passage 18*b*, the other end being in registry with the space between the valve plates when the stop valve 40 is at its closed position. Air, which is substantially at atmospheric pressure, is introduced through the conduit 48 into the space between the valve plates so as to ensure that the exhaust gases charged in the second intake passage 18*b* cannot escape into the first intake passage 18*a* when the stop valve 40 closes.

The stop valve 40 is driven by a second pneumatic valve actuator 42 which is substantially similar to the first valve actuator 32. The working chamber 42*a* of the second valve actuator 42 is connected to the outlet of a second three-way solenoid valve 44. The solenoid valve 44 has an atmosphere inlet communicated with atmospheric air and a vacuum inlet connected to a vacuum tank 46. The vacuum tank 46 is connected through a check valve to the induction passage 12 downstream of the throttle valve 16 where suction vacuum is developed during engine operation so that it can be held at a high degree of vacuum.

The second solenoid valve 44 is normally in a position providing communication between the second valve actuator working chamber 42*a* and atmospheric air so as to open the stop valve 40. When the engine operation is in a split engine mode, the first solenoid valve 44 is moved to another portion where communication is established between the second valve actuator working chamber 42*a* and the vacuum tank 46 so as to close the stop valve 40.

The reference numeral 50 designates an injection control circuit which provides, in synchronism with engine speed such as represented by spark pulses from an ignition coil 52, a fuel-injection pulse signal A of pulse width proportional to the air flow rate sensed by the airflow meter 14 and corrected in accordance with an air/fuel ratio indicative signal from the exhaust gas sensor 24. The fuel-injection pulse signal A is applied directly to fuel injection valves $g_1$ to $g_3$ for supplying fuel to the respective cylinders #1 to #3 and also through a split engine control circuit 54 to fuel injection valves $g_4$ to $g_6$ for supplying fuel to the respective cylinders #4 to #6. Each of the fuel injection valves $g_1$ to $g_6$ may be in the form of an ON-OFF type solenoid valve adapted to open for a period corresponding to the pulse width of the fuel-injection pulse signal.

The split engine control circuit 54 determines the load at which the engine is operating from the pulse width of the fuel injection pulse signal. At high load conditions, the split engine operating circuit 54 permits the passage of the fuel-injection pulse signal A from the injection control circuit 50 to the fuel injection valves $g_4$ to $g_6$ and provides a high load indicative signal to a valve drive circuit 56. When the engine load falls below a given value, the split engine control circuit 54 blocks the flow of the fuel-injection pulse signal from the injection control circuit 50 to the fuel injection valves $g_4$ to $g_6$ and provides a low load indicative signal to the valve driven circuit 56.

The valve drive circuit 56 is responsive to the high load indicative signal from the split engine operating circuit 54 to hold the first and second three-way solenoid valves 34 and 44 in their normal positions so as to close the EGR valve 30 and open the stop valve 40. The valve drive circuit 56 is also responsive to the low load indicative signal from the split engine operating circuit 54 to change the positions of the first and second three-way solenoid valves 34 and 44, thereby opening the EGR valve 30 and closing the stop valve 40.

For the purpose of improving engine starting operation, the split engine control circuit 54 has normally been designed to force the engine to operate in a full engine mode regardless of engine load conditions until the engine is completely warmed up except when the throttle valve is fully closed. With such a split engine control circuit, however, when the engine starts again under warmed conditions, the engine operation may be shifted into a split engine mode before the vacuum in the vacuum tank 46 reaches a level sufficient to permit the second valve actuator 42 to move the stop valve 40 to its fully closed position. If the stop valve 40 remains incompletely closed during a split engine mode of operation, a part of fresh air to be introduced into the cylinders #1 to #3 will flow through the stop valve 40 into the cylinders #4 to #6, and as a result the mixture in the cylinders #1 to #3 becomes richer than the target value. In addition, exhaust gases escape through the stop valve 40 into the cylinders #1 to #3, causing unstable engine operation and eventually engine stalling.

Figure 2:
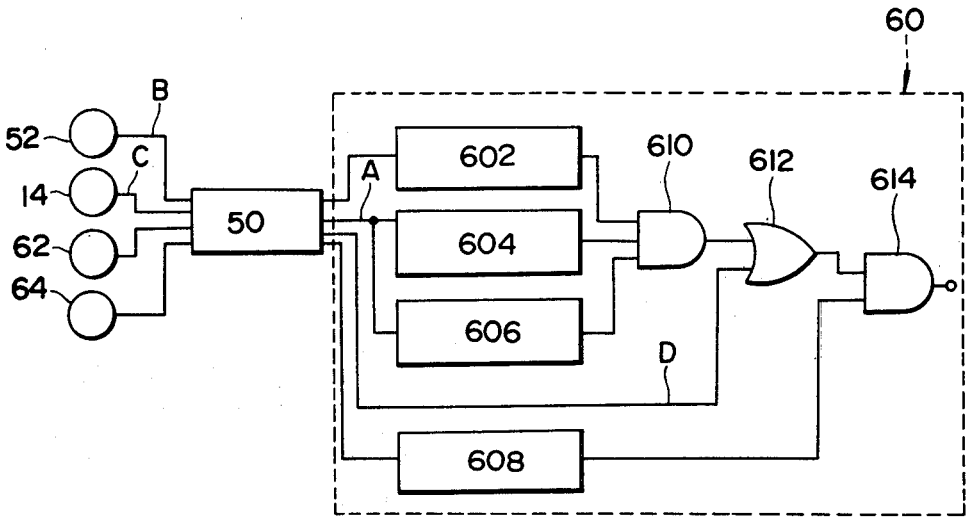
FIG. 2 is a block diagram showing a significant portion of a split engine control circuit made in accordance with the present invention.

FIG. 2 illustrates a significant portion of a split engine control circuit 60 constructed in accordance with the present invention. The split engine control circuit 60 is shown as associated with the injection control circuit 50 described in connection with FIG. 1. In FIG. 2, the reference numeral 62 designates an engine coolant temperatur sensor, and the numeral 64 an idle switch adapted to provide an idle signal when the throttle valve 16 is in its fully closed position.

The split engine control circuit 60 includes an engine-warming decision circuit 602 which makes a determination as to whether or not the engine is warmed up from the output of the engine coolant temperature sensor 62 and provides a high output when the engine is warmed up. The output of the engine-warming decision circuit 602 is connected to one input of a first AND circuit 610. The fuel-injection pulse signal A from the injection control circuit 50 is fed to a pulse-width decision circuit 604 and also to an engine-speed decision circuit 606. The pulse-width decision circuit 604 provides a high output to another input of the first AND circuit 610 when the pulse width of the fuel-injection pulse signal A, which is proportional to the engine load, is below a predetermined value. The engine-speed decision circuit 606 provides a high output to the other input of the first AND circuit 610 when the frequency of the fuel-injection pulse signal A, which is proportional to the engine speed, is above a predetermined value. The first AND circuit 610 provides a high output only when all of the outputs of the decision circuits 602, 604 and 606 are high; that is, when the engine is warmed up, the engine load is below a predetermined value, and the engine speed is above a predetermined value.

The output of the first AND circuit 610 is connected to one input of an OR circuit 612, the other input of which receives an idle signal D from the idle switch 64 when the throttle valve 16 is in its fully closed position. The OR circuit 612 provides a high output regardless of engine warming, load and speed conditions when the throttle valve 16 is fully closed.

The output of the OR circuit 612 is connected to one input of a second AND circuit 614. The other input of the second AND circuit 614 is connected to an inhibit circuit 608 which provides a low output before the vacuum in the vacuum tank 46 reaches a value sufficient to move the stop valve 40 to its fully closed position. The split engine control circuit 60 is adapted to place the engine operation in a full engine mode when the second AND circuit 614 provides a low output and shift the engine operation into a split engine mode when the second AND circuit 614 provides a high output.

The inhibit circuit 608 may comprise a timer which provides a low output during engine starting operation and a high output a predetermined time (about 2 seconds) after the ignition switch (not shown) is turned on and the injection control circuit 50 is powered. The time predetermined for the timer should be selected such that the vacuum in the vacuum tank 46 can reach a level sufficient to permit the second valve actuator 42 to completely close the stop valve 40 before the lapse of the predetermined time. That is, until the predetermined time lapses after the engine starts, the timer provides a low output to hold the output of the second AND circuit 614 low so that the engine operation is held in its full engine mode where the engine operates on all of the cylinders #1 to #6 regardless of other engine operating conditions.

After the lapse of the predetermined time during which the vacuum in the vacuum tank 46 reaches a sufficient level, the output of the second AND circuit 614 is dependent upon the output of the OR circuit 612. Assuming that the throttle valve 16 is in its fully closed position, the OR circuit 612 provides a high output and thus the second AND circuit 614 provides a high output, which shifts the engine operation into a split engine mode where the engine operates only on the cylinders #1 to #3. If the throttle valve 16 is not in its fully closed position, the second AND circuit 614 provides a high output to place the engine operation in its split engine mode only when all of the outputs of the decision circuits 601, 604 and 606 are high.

Alternatively, the inhibit circuit 608 may comprise a vacuum sensor adapted to provide a low signal when the vacuum developed in the induction passage 12 somewhere downstream of the throttle valve 16 is below a predetermined value sufficient to permit the second valve actuator 42 to completely close the stop valve 40 and provides a high signal when the vacuum is in excess of the predetermined value. Until the vacuum in the induction passage 12 downstream of the throttle valve 16 reaches a predetermined level, the vacuum sensor provides a low output to hold the output of the second AND circuit 614 low so that the engine is forced to operate in its full engine mode regardless of engine warming, load and speed conditions. This arrangement can minimize the time required for the engine to operate in a full engine mode during engine starting, resulting in higher fuel economy.

It is to be noted that the same effect can be obtained by replacing the vacuum sensor with another vacuum sensor adapted to provide a high signal only when the vacuum in the vacuum tank 46 is in excess of a level sufficient to permit the valve actuator 42 to completely close the stop valve 40.

Figure 3:
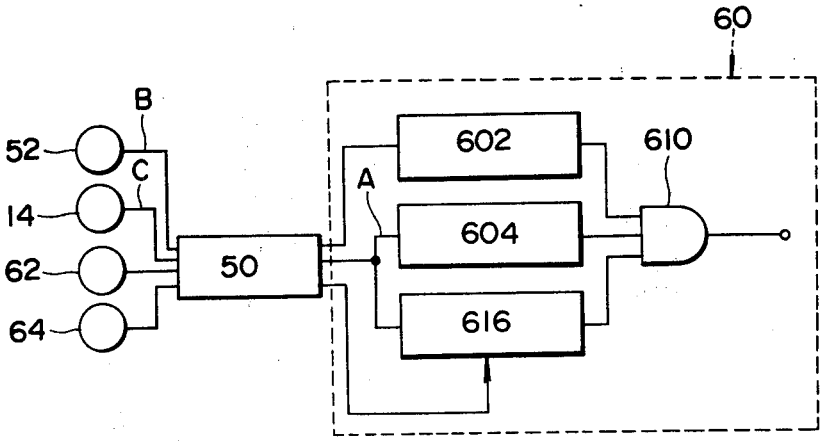
FIG. 3 is a block diagram showing another embodiment of the present invention.

Referring to FIG. 3, there is illustrated a second embodiment of the present invention wherein the split engine control circuit 60 comprises an engine-warming decision circuit 602, a pulse-width decision circuit 604, and an AND circuit 610 which are like those as described with reference to FIG. 2. The split engine control circuit 60 further comprises an engine-speed decision circuit 616 which provides a low output when the frequency of the fuel-injection pulse signal A, which is proportional to the engine speed, is below a predetermined value and which continues providing the low output regardless of engine speed conditions when the vacuum in the vacuum tank 46 or in the induction passage 12 downstream of the throttle valve 16 is below a level sufficient to permit the second valve actuator 42 to completely close the stop valve 40.

Until the vacuum in the vacuum tank 46 or in the induction passage 12 somewhere downstream of the throttle valve 16 exceeds the sufficient level, the decision circuit 616 provides a low output to hold the output of the AND circuit 610 low so that the engine operation is held in its full engine mode regardless of engine warming, load, and speed conditions. When the vacuum is in excess of the sufficient level, the output of the decision circuit 616 changes to its high level and thus the output of the AND circuit 610 is dependent upon the outputs of the engine-warming decision circuit 602 and the pulse-width decision circuit 604.

It will be apparent from the foregoing that the present invention permit an split type internal combustion engine to operate in its full cylinder mode regardless of engine load conditions before the vacuum in the vacuum tank reaches a value sufficient to move the stop valve to its fully closed position. This eliminates the possibility of the stop valve from incompletely closing during a split engine mode of operation.

While the present invention has been described in connection with specific embodiments thereof, it is evident that many alternatives, modifications and variations will be apparent to those skilled in the art. Accordingly, it is intended to embrace all alternatives, modifications and variations that fall within the spirit and broad scope of the appended claims.

What is claimed is:

1. An internal combustion engine comprising:

(a) first and second cylinder units each including at least one cylinder;

(b) an induction passage provided therein with a throttle valve and divided downstream of said throttle valve into a first intake passage leading to said first cylinder unit and into a second intake passage leading to said second cylinder unit;

(c) a vacuum tank held at a vacuum above that in said induction passage downstream of said throttle valve;

(d) a stop valve provided at the entrace of said second intake passage and adapted to move toward its closed position when connected to said vacuum tank;

(e) a control circuit adapted to normally place said engine in a full engine mode of operation, said control circuit adapted to block the supply of fuel to said second cylinder unit and connect said vacuum tank to said stop valve thereby shifting the engine operation into a split engine mode when the engine load is below a predetermined value; and (f) said control circuit including means for forcing the engine operation into its full cylinder mode regardless of engine load conditions before the vacuum in said vacuum tank reaches a value sufficient to move said stop valve to its fully closed position.

2. An internal combustion engine according to claim 1, wherein said means comprises a timer adapted to provide a signal for a predetermined period of time after said engine starts, and means responsive to the signal from said timer for holding the engine operation in its full engine mode regardless of engine load conditions.

3. An internal combustion engine according to claim 1, wherein said means comprises a vacuum sensor adapted to provide a signal when the vacuum in said induction passage downstream of said throttle valve is below a predetermined value sufficient to move said stop valve to its fully closed position, and means responsive to the signal from said vacuum sensor for holding the engine operation in its full engine mode regardless of engine load conditions.

4. An internal combustion engine according to claim 1, wherein said means comprises a vacuum sensor adapted to provide a signal when the vacuum in said vacuum tank is below a predetermined value sufficient to move said stop valve to its fully closed position, and means responsive to the signal from said vacuum sensor for holding the engine operation in its full engine mode regardless of engine load conditions.

5. An internal combustion engine according to claim 1, wherein said control circuit comprises an engine speed sensor adapted to provide a signal when the engine speed is below a predetermined value, and means responsive to the signal from said engine speed sensor for holding the engine operation in its full engine mode regardless of engine load conditions.

6. An internal combustion engine according to claim 5, wherein said engine speed sensor is adapted to continue providing the signal regardless of engine speed conditions when the vacuum in said induction passage downstream of said throttle valve is below a predetermined value sufficient to move said stop valve to its fully closed position.

7. An internal combustion engine according to claim 5, wherein said engine speed sensor is adapted to continue providing the signal regardless of engine speed conditions when the vacuum in said vacuum tank is below a predetermined value sufficient to move said stop valve to its fully closed position.

* * * * *